United States Patent [19]

Edwards

[11] 4,279,091

[45] Jul. 21, 1981

[54] FIREARM RECOIL REDUCER

[76] Inventor: Jesse B. Edwards, 269 Herbert St., Alton, Ill. 62002

[21] Appl. No.: 99,557

[22] Filed: Dec. 3, 1979

[51] Int. Cl.[3] ..... F41C 27/00

[52] U.S. Cl. ..... 42/1 V

[58] Field of Search ..... 42/1 V

[56] References Cited

U.S. PATENT DOCUMENTS

| | | | |
|---|---|---|---|
| 3,290,815 | 12/1966 | Edwards | 42/1 V |
| 3,300,889 | 1/1967 | Baker | 42/1 V |
| 3,381,405 | 5/1968 | Edwards | 42/1 V |
| 3,408,062 | 10/1968 | Baker | 42/1 V |
| 4,164,825 | 8/1979 | Hutchison | 42/1 V |

*Primary Examiner*—Charles T. Jordan

*Attorney, Agent, or Firm*—Kalish & Gilster

[57] ABSTRACT

A recoil reducing device for a firearm including a hollow sleeve received within a chamber of the stock of the firearm, with one end directed toward the receiver of the firearm and the other end directed away from it and with closures at opposite ends of the sleeve. A pair of radially projecting lugs externally position the device and space the sleeve within the chamber. A weighted piston is slideably received within the sleeve and biased into a central position therein by springs on opposite ends. The piston is provided with a lubricant reservoir and means for permitting the lubricant to flow from the reservoir to the outer surface of the piston. Further, the closure at the sleeve end directed toward the stock is provided with an outer face presenting closely spaced teeth at equal angular intervals for establishing a predetermined angular orientation of the device within the chamber. The opposite end closure has an outer end face presenting a tool receiving recess for permitting adjustment of the angular orientation.

10 Claims, 8 Drawing Figures

FIG. 1
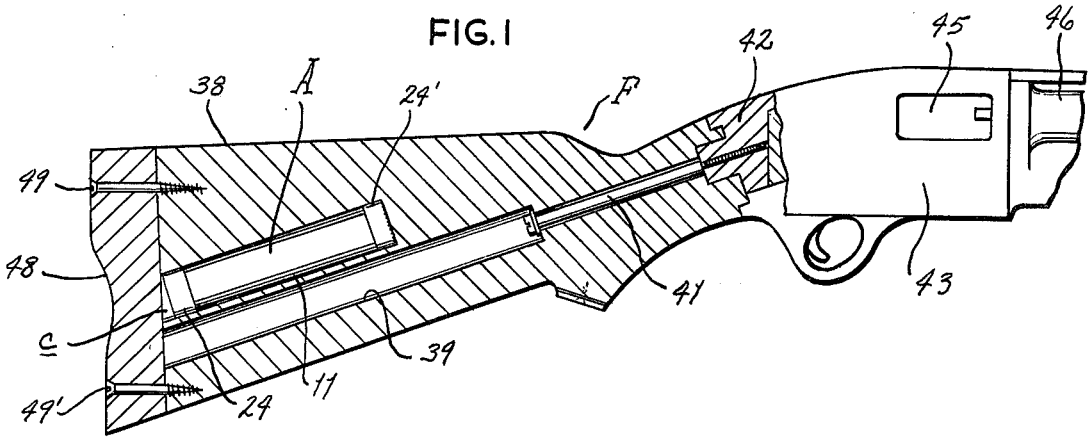
FIG. 2
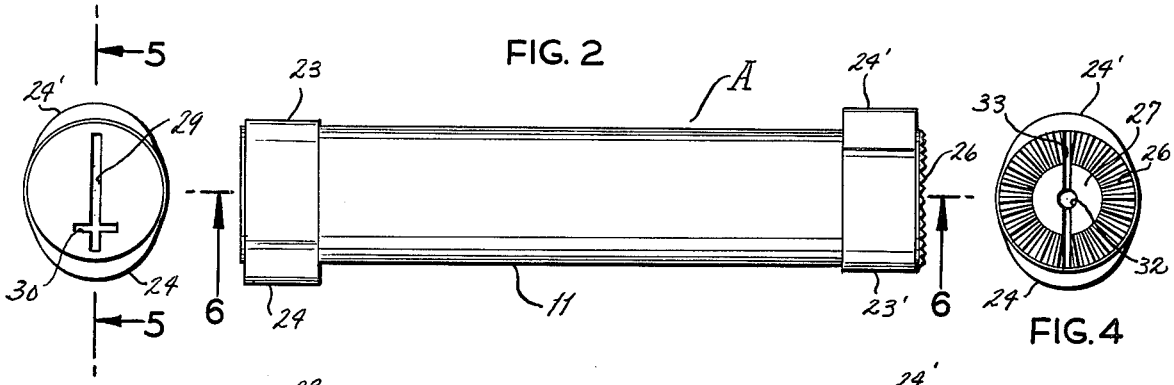
FIG. 3
FIG. 4
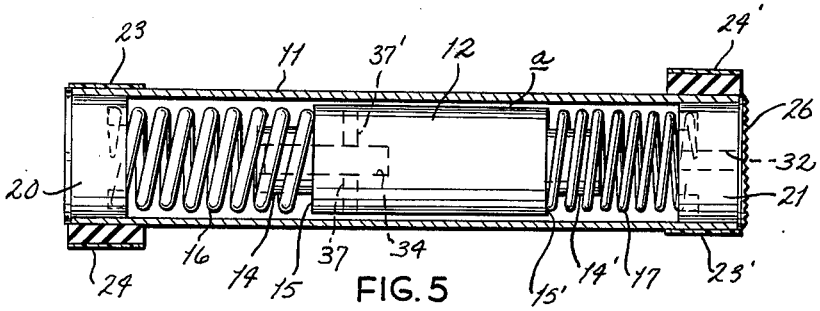
FIG. 5
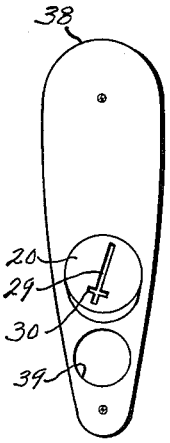
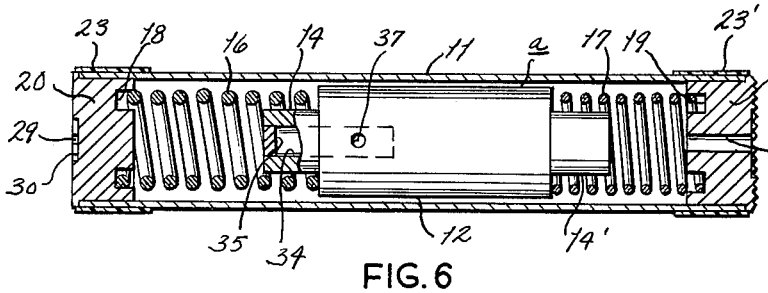
FIG. 6
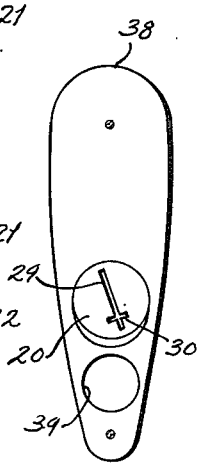
FIG. 7
FIG. 8

FIREARM RECOIL REDUCER

BACKGROUND AND SUMMARY OF THE INVENTION

This invention relates in general to firearms and, more particularly, to a device or mechanism for installation within existing firearms for reducing firing recoil and barrel whip.

The invention is concerned with an improvement of the firearm recoil reducer disclosed in Edwards U.S. Pat. No. 3,381,405, entitled "Firearm Recoil Reducer."

In the equippage of firearms with a recoil reducer of the type described in the above identified Edwards patent, wherein the device has a piston disposed within a sleeve in slideable relationship, it is found that after many rounds have been fired in the firearm, there is a need for lubrication between the piston and the sleeve to ensure that the piston will remain freely movable upon firing to compensate for recoil and otherwise continue to provide reliable and proper operation. It is a task of considerable difficulty and irksome character to have to lubricate the piston by disassembling the unit or removing lubrication orifice screws or the like. Such also requires the removal of the butt plate. Further, it has been found that, after repeated firing of many rounds, the sleeve may tend to rotate within the chamber of the firearm stock in which it is positioned. Yet it is important to maintain the precisely angular orientation for proper operation of the device. Even small incremental changes in angular orientation of the device about its longitudinal axis can produce readily detectable changes in recoil against the shoulder and face of the shooter.

It is an object of the present invention to provide an improved recoil reducer which is suited for installation within existing firearms for effectively reducing recoil and barrel whip upon firing thereof.

It is a further object of the present invention to provide an improved recoil reducer of the type stated which is adapted for facile installation within the stock of substantially any type of rifle, shotgun, or other semi-automatic or automatic firearm equipped with a shoulder stock or the like without necessitating costly modification of the firearm or reducing its effective operation; such installation being readily effected by the average firearm user.

It is another object of the present invention to provide an improved recoil reducer of the type stated wherein the relatively movable elements of the mechanism are maintained in a lubricated condition for a long period of time and after many rounds of firing.

It is yet another object of the present invention to provide an improved recoil reducer of the type stated which reliably provides, over many rounds of firing, a precise predetermined angular orientation of the mechanism within the stock.

It is still a further object of the present invention to provide an improved recoil reducer of the type stated which readily permits adjustment of the angular orientation of the mechanism within the firearm stock by the firearm user.

Among still other objects of the present invention are the provision of an improved recoil reducer of the type stated which is economically manufactured; which comprises relatively few parts, all of which are simple in construction; which is extremely durable and reliable in usage; and which provides longevity of usage without need for lubrication or adjustment.

Other objects and details of the invention will be in part apparent and in part pointed out hereinbelow.

BRIEF DESCRIPTION OF THE DRAWING

FIG. 1 is a fragmentary longitudinal view in partial vertical section of the breech and stock portion of a firearm incorporating an improved firearm recoil reducer constructed in accordance with and embodying the present invention.

FIG. 2 is a side elevational view of the new recoil reducer.

FIG. 3 is an end elevational view of the recoil reducer as viewed from the left end side of FIG. 2.

FIG. 4 is an end elevational view of the recoil reducer as viewed from the right hand side of FIG. 2.

FIG. 5 is a vertical transverse sectional view taken along line 5—5 of FIG. 3.

FIG. 6 is a transverse horizontal sectional view taken along line 6—6 of FIG. 2.

FIGS. 7 and 8 are an end elevational view of the stock of the firearm of FIG. 1 with the butt plate removed showing different orientations of the recoil reducer for left-and right-handed shooters, respectively.

Corresponding reference characters indicate corresponding parts throughout the several views of the drawing.

DESCRIPTION OF THE PREFERRED EMBODIMENT

Referring now by reference characters to the drawing which illustrates the preferred embodiment of the present invention, A generally designates a firearm recoil mechanism or device containing a cylindrical sleeve or tubular casing 11 fabricated of suitable lightweight, durable metal, such as aluminum. Within sleeve 11 there is disposed for axial, slideable movement therein a cylindrical piston 12, of relatively massive character, being of a dense metal, as compared with aluminum, to provide relatively heavy mass with respect to the lightweight sleeve 11. The outside diameter of piston 12 is slightly less than the inside diameter of sleeve 11 to provide the capability of slideable movement of the piston within the sleeve with a relatively small circumferential air passage between the piston and sleeve, as indicated at a, yet not preventing the piston from slideably contacting the inner diameter of sleeve 11 during movement of the piston during firing recoil of the firearm, such friction being greatly minimized by lubricant supplied to the outside diameter surface of piston 12 in accordance with the provision of features hereinbelow described.

Integrally formed, and coaxial, with piston 12 are extensions 14,14' at opposite ends of the piston and projecting from each end face of the piston, being of circular cross-section as compared with the main body of the piston and being of reduced diameter to define with the end faces of the piston annular shoulders 15,15'. Bearing against each shoulder and surrounding the projections 14,14' are respective compression springs 16,17. The springs have an inner diameter slightly greater than the outside diameter of extensions 14,14'. The opposite or outer ends of springs 16,17 are received within annular recesses 18,19 of respective end closures 20,21 of the device, which are securely received within the opposite ends of sleeve 11. The cross-section of recesses 18,19 is substantially equal to the outside diameter of each of the coil springs 16,17 so that the latter are received snugly therein to prevent noise or rattle, as well as assuring stable engagement of the springs for preventing undesired shifting. Furthermore, recesses 18,19 serve to bring about a relative reduction in the overall length of mechanism A, as is desirable in the equippage of a firearm with the mechanism. Each of end closures 20,21 is provided with a marginal flange or bead which is rolled onto sleeve 11 so as to bring about a unified, relatively sealed construction between the sleeve and end closures. The end closures 20,21 thus serve as bearing plates for the associated springs 16,17, by virtue of the retention of the piston 12 between the springs in a central position within sleeve 11, the piston is restrained from movement except by compression of one of the springs with accompanying elongation of the other spring. Preferably, as evident, spring 16 is of relatively greater length and heavier material, as compared with spring 17, so as to provide a greater spring force upon compression than spring 17 and with piston 12, accordingly, being slightly to the right of center as viewed in FIGS. 5 and 6, but nevertheless occupying a substantially central position within the sleeve.

Mounted surroundingly of each end closure 20,21 is a collar 23,23', respectively, formed of plastic or other elastomeric material having a limited resiliency whereby each collar 23,23' is elastically deformable upon being compressed, as occurs in a manner more fully developed hereinbelow. These collars are suitably affixed to the outer face portion of sleeve 11 to prevent undesired rotation or axial shifting. Each collar 23,23' incorporates a relatively thickened segmental portion defining a lug, as at 24,24', respectively. These lugs are each formed on an arc of approximately 90 degrees and project from opposite sides of sleeve 11 in diametrically opposed relationship with the center thereof being at a mutual angle of 180 degrees, as is apparent from FIG. 4.

The outer face of end closure 21 is provided with numerous teeth 26 which are spaced apart in equal angular intervals and are radially disposed about the longitudinal axis of the sleeve and its end closure 21 but leaving a central flat area 27 in the enclosure. The teeth extend thus longitudinally forward and are adapted to engage and make corresponding indentations in the wood, plastic or other material of the stock of the firearm inserted within a chamber provided within the stock, as by boring. Such teeth serve to engage the closed end of such chamber to maintain a precise predetermined annular orientation of the mechanism within the chamber and so closely spaced, e.g., being at annular intervals of substantially less than 15 degrees about the longitudinal axis, that by selective rotation of the device, it can be re-oriented to provide an adjustment of the predetermined annular orientation, as may be required for proper adjustment of the device for its proper recoil absorbing operation. Thus, if 27 teeth are provided, there are $13\frac{1}{3}$ degrees between each tooth so that the device can be adjusted by rotation in increments of $13\frac{1}{3}$ degrees.

For adjustment purposes, the outer face of the opposite end closure 20 (FIG. 3) is provided with a diametrically extending recess 29 of appropriate depth and transverse extent for accommodating a screwdriver. Intersecting said recess 29 proximate one of its ends is a relatively short and shallow recess 30 serving as a visual indicator to indicate the proper initial orientation of the device upon equipping a firearm therewith.

As noted above, piston 12 is slideably movable within sleeve 11 during firing of a firearm having the device and, to ensure that air will be permitted to enter or leave the interior of sleeve 11 and thus to maintain a normal pressure at all times at both ends of piston 12, end closure 21 is provided with a small central aperture or vent 32 therethrough concentric with the longitudinal axis of end closure 21. Further, a recess or groove 33 extending transversely across the face of closure 21 and vent 32 additionally helps air pass through the end of the unit.

Referring to FIGS. 5 and 6, piston 12 is provided with a reservoir 34 for the containment of a jelly-like lubricant having a very high viscosity, e.g., like petroleum jelly. Such reservoir is constituted by a bore or cylindrical recess extending inwardly from extension 14 toward the center of the piston and coaxial with its axis of cylindricity, said recess being closed in its outer end by a plug or cap 35. Extending transversely of and intersecting reservoir 34 is a further bore providing two passages 37,37' which provide communication between reservoir 34 and the cylindrical outer surface of the piston thereby to permit the lubricant within the reservoir to flow to said piston outer surface for providing lubricant between the piston and sleeve. Due to the fact that the jelly-like lubricant is not of a readily fluid character, it will, in the course of firing hundreds or thousands of rounds in the firearm, gradually be caused to exude from reservoir 34 but thus ensuring over a very long period of time the presence of lubricant upon the outer surface of piston 12 so as to maintain a relatively friction-free sliding relationship between the piston and sleeve 11 over the lifetime of the device and firearm. It may be observed that passages 37,37' communicate with reservoir 34 toward its forward end. Hence, if the firearm is stored, as is typical, by standing it upon its butt plate, the lubricant will tend to be maintained within the reservoir and, even if there should be high ambient temperatures, such as might tend to cause increased flow of lubricant, the lubricant will be maintained reliably within reservoir 34 by plug 35.

In usage, recoil reducing mechanism A is received within a substantially complementarily formed compartment c drilled or otherwise bored within the normally wooded stock 38 of a firearm (which may be a rifle, shotgun or other stock equipped firearm including semi-automatic or automatic weapons) as indicated at F. Compartment c is formed along an axis parallel to the axis of a bore or drawbolt opening 39 normally formed within the stock of firearm F and thus at the same angle to the barrel of the firearm as the axis of drawbolt opening 39. Such advantageously avoids formation of compartment c so as to cut into drawbolt opening 39 and thus preserves the integrity and strength of stock 38. The drawbolt opening receives at its inner end the head of the customary drawbolt or tangbolt 41 by which the stock 38 is secured to the receiver or frame 42 of firearm F which includes the usual cartridge handling chamber 43 and ejector 45 and the firearm, of course, the barrel 46 extending forwardly from the receiver.

Compartment c is provided preferably with a length slightly greater than mechanism A and is of such diameter as to accommodate lugs 24,24' with some degree of resilient compressing of the lugs thereby to provide a snug fit within chamber c. The outer end of compartment c, as well as drawbolt opening 39, are closed by a butt plate 48 which is secured to stock 38 by screws 49,49'.

With recoil redùcing mechanism A inserted within compartment c (see FIG. 1) and with butt plate 48 mounted in closing position, the shooter or rifleman is then free to fire the firearm F. Upon firing, the initial, as well as subsequent or secondary recoils, are translated through the receiver and stock, acting upon and being received by piston 12, which is driven alternately against the springs 16,17 so that the energy of recoil, as received by the mechanism, is substantially absorbed by the springs. Upon movement of the piston 12 within sleeve 11, air is permitted to vent through a vent 32 as the piston moves reciprocally within sleeve 11 until the springs 16,17 have dissipated the energy of recoil.

As indicated above, extensions 14,14' of the piston, as well as recesses 18,19, assure the axial travel of piston 12 during energy-absorbing action without the occurrence of inadvertent friction-producing engagement of the interface of sleeve 11 by the springs, and also reduce frictional engagement of the inner surface of the sleeve by piston 12. Said extensions 14,14' and recesses 18,19 also readily facilitate assembly of mechanism A.

The use of the present invention prevents the incidents of painful bruises and even numbing by the user, which injurious conditions have been heretofore accepted by riflemen, marksmen, and the like as a risk associated with riflery and firing of other firearms having high recoil. Furthermore, the present invention substantially obviates firearm "jumping," in effect, preventing so-called barrel whip so that the user may enjoy the same accuracy upon repeated firing as when rapid fire is undertaken.

When mechanism A is installed within compartment c, lugs 24,24', being diametrically opposed to each other, will assure of appropriate disposition of mechanism A within compartment c, and with the inherent compressibility of lugs 24,24' assuring of a proper accommodation of mechanism A within compartment c regardless of any imperfections in the substantially circular cross-section thereof. Furthermore, the lugs provide an added cushioning effect for preventing any undue transmission of forces from mechanism A to stock 38 with resultant discomfort to the shooter.

Upon installation of the unit in a firearm as illustrated in FIG. 1, teeth 26 at the forward end of the unit bitingly engage and form corresponding indentations on the forward end of compartment c when mechanism A is installed as intended, preferably including tapping the outer end of the mechanism. Because of the presentation of the tool receiving recess 29 on the rear end closure of mechanism A, the shooter may then adjust the unit as to its angular orientation within compartment c so as to orient the device for the proper absorbing of recoil upon firing. Thus, upon firing, should the shooter detect bumping of the cheek or undue recoil sensations, he may adjust the unit by inserting a screwdriver in recess 29 and turning the unit either to the left or the right by an angular increment defined by the angular spacing between the teeth. It is found that with left handed shooters, an orientation of the unit with the recess being aligned, as indicated in FIG. 7, will be desirable, whereas with a right handed shooter, the orientation of the recess being depicted as viewed in FIG. 8 will be desirable. By virtue of the close angular spacing of the teeth, the shooter may make a very fine degree of adjustment as will be apparent from the small difference in angular orientations depicted as between FIGS. 7 and 8. When turned by a screwdriver, the user will, because of the indentations produced at the end of compartment c by teeth 26, feel the seating of the teeth in the indentations, which feeling is conveyed through the screwdriver and may be heard also by a popping or clicking sound made as the teeth seat in indentations upon being turned.

Once adjusted to the precisely chosen angular orientation which the shooter prefers to minimize any undue sensations or bumping of the cheek during shooting, the device maintains this precisely predetermined orientation because of the positive engagement of the teeth against the stock material at the end of compartment c.

By virtue of the lubrication features of the new recoil reducer, a small amount of lubrication is presented within the rear of piston 12, being located within reservoir 34 and dispensed therefrom over a long period of time, e.g., over hundreds and thousands of rounds of firing. Because of this feature, the new mechanism requires only a relatively small amount of lubricant to be provided at the time of manufacturing and precludes the undesirable overloading or clogging up of the mechanism which would otherwise be necessary if the unit were heavily lubricated, as by liberally coating the inner surfaces of sleeve 11, at the time of assembly of the unit upon manufacture. Further, excess lubricant would tend to be discharged through vent 32. But, the small amount of lubricant contained within reservoir 34 avoids such overloading and assures the continued functioning of mechanism A over a long period of time. Further, even when the firearm is stored by standing it upon butt plate 48, the lubricant is reliably maintained within reservoir 34 even under conditions of excessive ambient temperatures, as may result in warm climates or seasons since, even if the heat should be sufficiently high as to cause the lubricant to become liquified or readily fluent, the lubricant will, upon the firearm remaining in a vertical position, simply be maintained within reservoir 34 by plug 35.

It should be understood that changes and modifications in the foregoing formation, construction, arrangement and combination of the several parts of the firearm recoil reducer may be made and substituted for these herein showed and described without departing from the nature and principle of my invention.

What I claim:

1. In combination with a firearm having components including a barrel, a receiver, and stock integrated into fixed relationship so that no relative movement between said firearm components may occur when firing, a recoil reducing mechanism disposed within said stock, said mechanism comprising housing means forming a sleeve having one end directed toward said receiver and an opposite end directed away from said receiver, closures at the opposite ends of said sleeve, a pair of radially projecting lugs externally of said sleeve at the opposite ends thereof and on opposite sides thereof, a piston slideably received within said sleeve for slideable movement therein upon recoil of said firearm when firing, and resilient means for biasing said piston into a central position between the opposite ends of said sleeve, a reservoir within said piston for containing a quantity of lubricant, and means for supplying said lubricant from said reservoir to an outer surface of said piston for providing lubricant between said piston and sleeve.

2. In combination with a firearm having components including a barrel, a receiver, and stock integrated into fixed relationship so that no relative movement between said firearm components may occur when firing, a recoil reducing mechanism as defined in claim 1 and further characterized by said mechanism being disposed in a bore defining a chamber within said stock having a closed end disposed toward said receiver, the closure at said one end of said mechanism directed toward said receiver providing an outer end face bearing against the closed end of said chamber, said end face presenting a plurality of teeth for positively engaging said closed end of said chamber.

3. In combination with a firearm having components including a barrel, a receiver, and stock integrated into fixed relationship so that no relative movement between said firearm components may occur when firing, a recoil reducing mechanism as defined in claim 2 and further characterized by said sleeve being adapted to be rotated in said chamber about a longitudinal axis of said sleeve, said teeth being radially disposed in closely spaced, equal angular intervals about said axis whereby said teeth are oriented for positively engaging said closed end of said chamber to maintain a predetermined angular orientation of said mechanism within said chamber.

4. In combination with a firearm having components including a barrel, a receiver, and stock integrated into fixed relationship so that no relative movement between said firearm components may occur when firing, a recoil reducing mechanism as defined in claim 3 and further characterized by said teeth being spaced in equal angular intervals of substantially less than 15 degrees about said axis.

5. In combination with a firearm having components including a barrel, a receiver, and stock integrated into fixed relationship so that no relative movement between said firearm components may occur when firing, a recoil reducing mechanism as defined in claim 3 and further characterized by the closure at the end of said sleeve directed away from said receiver providing an outer end face presenting a tool receiving recess for permitting adjustment of the predetermined angular orientation of said mechanism within said chamber.

6. In combination with a firearm having components including a barrel, a receiver, and stock integrated into fixed relationship so that no relative movement between said firearm components may occur when firing, a recoil reducing mechanism as defined in claim 3 and further characterized by the last-said closure having an aperture therein centrally of said end closure providing communication to the interior of said sleeve for venting air with respect to the interior of said sleeve upon slideable movement of said piston within said sleeve.

7. In combination with a firearm having components including a barrel, a receiver, and stock integrated into fixed relationship so that no relative movement between said firearm components may occur when firing, a recoil reducing mechanism as defined in claim 1 and further characterized by said means for providing said lubricant comprising at least one aperture in said piston communicating between said reservoir and said piston outer surface for flow of said lubricant to said outer surface.

8. In combination with a firearm having components including a barrel, a receiver, and stock integrated into fixed relationship so that no relative movement between said firearm components may occur when firing, a recoil reducing mechanism as defined in claim 7 and further characterized by said sleeve and piston each being cylindrical, said piston having a longitudinal axis, said piston being slideably movable within said sleeve along said axis and having a central bore extending along at least a portion of the length of said piston coaxial with said axis, said aperture being constituted by a plurality of passages extending transversely into the first-said bore, and the first-said bore being closed at opposite ends.

9. In combination with a firearm having components including a barrel, a receiver, and stock integrated into fixed relationship so that no relative movement between said firearm components may occur when firing, a recoil reducing mechanism as defined in claim 8 characterized by the first-said bore extending substantially less than half the length of said piston from one end thereof, and the first-said bore being closed at said one end by a plug and containing a lubricant having a sufficiently high viscosity that said lubricant is jelly-like at room temperature.

10. In combination with a firearm having components including a barrel, a receiver, and stock integrated into fixed relationship so that no relative movement between said firearm components may occur when firing, a recoil reducing mechanism as defined in claim 9 and further characterized by said lugs being formed of compressible elastic material, being of arcuate character and disposed at an angle of 180 degrees to each other, said lugs bearing against opposite inner wall surfaces of said chamber.

* * * * *